US007972221B2

(12) United States Patent
Furze et al.

(10) Patent No.: US 7,972,221 B2
(45) Date of Patent: Jul. 5, 2011

(54) METHOD OF SPHERICAL OBJECT ORIENTATION AND ORIENTER FOR THE SAME

(75) Inventors: Paul A Furze, Tiverton, RI (US); Thomas L Mydlack, Rochester, MA (US); Michael F Vieira, Acushnet, MA (US); Donald A Laprade, Acushnet, MA (US); Edmund T Maher, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 1872 days.

(21) Appl. No.: 10/797,797

(22) Filed: Mar. 10, 2004

(65) Prior Publication Data

US 2005/0202886 A1 Sep. 15, 2005

(51) Int. Cl.
*A63D 5/08* (2006.01)

(52) U.S. Cl. ..... 473/151; 473/152; 473/351

(58) Field of Classification Search ..... 473/151, 473/152, 351; 382/100, 141
See application file for complete search history.

(56) References Cited

U.S. PATENT DOCUMENTS

| | | | | | |
|---|---|---|---|---|---|
| 3,778,067 | A | * | 12/1973 | Gentiluomo | 473/133 |
| 4,240,620 | A | | 12/1980 | Tunkers | 269/24 |
| 4,445,628 | A | | 5/1984 | Cain | 222/66 |
| 5,223,679 | A | | 6/1993 | Yoo | 187/134 |
| 5,604,550 | A | | 2/1997 | White | 396/429 |
| 5,611,723 | A | * | 3/1997 | Mitoma et al. | 451/6 |
| 5,632,205 | A | * | 5/1997 | Gordon et al. | 101/483 |
| 5,703,687 | A | | 12/1997 | Kumagai et al. | 356/426 |
| 5,777,244 | A | | 7/1998 | Kumagai et al. | 73/865.8 |
| 5,859,923 | A | * | 1/1999 | Petry et al. | 382/141 |
| 5,903,341 | A | | 5/1999 | Perry et al. | 356/237 |
| 6,031,933 | A | | 2/2000 | Kumagai | 382/141 |
| 6,450,082 | B1 | | 9/2002 | Sawdon | 92/23 |
| 6,462,303 | B1 | | 10/2002 | Brown | 219/121.69 |
| 6,462,812 | B1 | | 10/2002 | Heene et al. | 356/237.1 |
| 6,608,687 | B1 | | 8/2003 | Rulevich et al. | 356/601 |
| 6,630,998 | B1 | | 10/2003 | Welchman et al. | 356/394 |
| 7,283,657 | B1 | * | 10/2007 | Carlson | 382/141 |
| 2001/0012389 | A1 | * | 8/2001 | Welchman et al. | 382/141 |
| 2001/0043757 | A1 | * | 11/2001 | Asakura | 382/289 |
| 2002/0092731 | A1 | * | 7/2002 | Osterfeld et al. | 198/470.1 |
| 2002/0135743 | A1 | | 9/2002 | Gindele | 355/18 |
| 2003/0031359 | A1 | * | 2/2003 | Miki et al. | 382/154 |
| 2003/0095178 | A1 | | 5/2003 | Shibayama | 348/46 |

OTHER PUBLICATIONS

"Increasing Step Motor Performance" from Industrial Devices Corp.
Method of Calibrating a Detector and Calibration Sphere for the same, U.S. Appl. No. 10/776,429.

* cited by examiner

*Primary Examiner* — Dmitry Suhol
*Assistant Examiner* — Brandon Gray
(74) *Attorney, Agent, or Firm* — Daniel W. Sullivan

(57) ABSTRACT

A method of orienting a spherical object comprising the steps of acquiring an image of a spherical object at an imaging station; analyzing the image with a first computer to determine an analysis; transferring the object from the imaging station to orienting stations using a transfer mechanism; and orienting the object to a predetermined orientation according to the analysis; wherein the orienting stations comprise first, second, and third stations each rotating the object about a single axis; the first, second, and third stations collectively orienting the object by rotation about alternately perpendicular axes. In one embodiment, at least one of the orienting stations is at least partially mounted onto the transfer mechanism. In another embodiment, the transfer mechanism is a compliant object carrier that is movable translationally and substantially immovable rotationally. In an alternate embodiment, the ball is orientated with a gimbaled mechanism. An object orienter is also disclosed.

12 Claims, 12 Drawing Sheets

METHOD OF SPHERICAL OBJECT ORIENTATION AND ORIENTER FOR THE SAME

FIELD OF THE INVENTION

This invention generally relates to a method orienting spherical objects and an orienter for the same. This invention more particularly relates to a method of accurately and quickly orienting a golf ball with a vision detection system, and an orienter that performs such method.

BACKGROUND OF THE INVENTION

The manufacture of golf balls involves a series of sequential processes performed at different stations. After one production process, it is sometimes necessary to change the orientation of the ball to optimize the performance of a subsequent process. For example, automated imaging inspection of golf ball indicia calls for an optimal golf ball positioning with respect to the camera that inspects the indicia.

Achieving a particular orientation is typically a two-step process. First, a golf ball's initial orientation must be ascertained. Second, the ball must be re-oriented.

Regarding the second orienting step, at least two distinct rotational movements can be used to accomplish orientation of a randomly positioned golf ball or other spherical object. With reference to the globe, the first move brings the poles to the vertical orientation. The second move rotates the ball about the polar axis to bring a longitudinal line to the front. Three rotational movements can also be used. The first movement is about a first axis. The second movement is about any second axis, which does not need to be perpendicular to the first axis. The third movement is about any third axis that is perpendicular to the second axis.

Several conventional detection and analysis systems produce images of golf balls to determine a required degree of repositioning for further processing, but they do not accurately orient golf balls. For instance, U.S. Pat. No. 5,611,723 discloses a detection, analysis, and modification system implemented to adjust the attitude of golf balls by rotating them about several axes before they undergo a subsequent de-burring process. This system detects and images golf balls to determine their relative positioning with respect to a predetermined golf ball attitude. The system then calculates the degree of modification required to achieve the predetermined attitude. In two motions, it rotates the golf balls to approximate the attitude, further images the balls, and finely tunes them to the desired attitude. This system, however, does not orient the ball. Plus, as the golf balls are picked up and put down during their transfer from one station to another, this system can tend to shift the balls, which introduces error into the positioning process.

Such shift or slip often occurs as a ball is picked up from one processing station and placed in another. As a golf ball is moved from one station to another, misalignment between a transfer mechanism element and a processing station can cause the ball to rotate, which accidentally changes its orientation so as to nullify the original image data that dictates the current automatic orientation. This rotational shift ultimately leads to an inaccurate orientation of the ball.

Other systems, while reducing such shift allows only one axis of rotation as the balls are moved out of a printing station. One such system is disclosed in commonly owned U.S. Pat. No. 6,630,998 B1, issued on Oct. 7, 2003, which is incorporated herein by reference in its entirety. This system teaches, among other things, an active golf ball indexer that uses a plate clamped into place to allow only one axis of movement while the balls are moved out of the printing operation. A metal arm with a suspended dog actuated by an air cylinder rotates the balls to view and analyze all indicia.

Other systems attempt to avoid rotational transfer shift by orienting golf balls in a single station. Before a golf ball is moved from the orienting station, these systems sequentially rotate the golf ball three separate times to achieve a desired orientation. As a result, excess time is spent orienting golf balls, which likewise can slow production.

The prior art, does not quickly orient golf balls while minimizing inaccuracy due to rotational shift or slip that occurs during golf ball transfer from one processing station to another.

SUMMARY OF THE INVENTION

Hence, the present invention is directed to a method of orienting spherical objects and an orienter that increase the processing speed of golf balls.

The present invention is also directed to a method of orienting golf balls and an orienter that minimize golf ball slip during transfers from one station to the next, and thereby improve the accuracy of orientation.

The present invention is also directed to a method of orienting spherical objects and an orienter that reduce the required amount of detection equipment.

The present invention is also directed to a method of orienting spherical objects and an orienter that allow easy adjustment of orienting motors or other equipment.

One aspect of the present invention is directed to a method of orienting a spherical object, comprising the steps of acquiring an image of a spherical object at an imaging station, analyzing the image with a first computer to determine an orientation analysis, transferring the object from the imaging station to orienting stations using a transfer mechanism, and orienting the object to a predetermined orientation according to the orientation analysis. The orienting stations comprise first, second, and third stations each rotating the object about a single axis. The first, second, and third stations collectively orient the object by rotation about axes that are alternately perpendicular.

Another aspect of the present invention is directed to a method of orienting a spherical object, comprising the steps of acquiring an image of a spherical object at an imaging station, analyzing the image with a first computer to determine an analysis, transferring the object from the imaging station to orienting stations using a transfer mechanism, and orienting the object to a predetermined orientation according to the analysis.

Another aspect of the present invention is directed to an orienter for a spherical object, comprising an imaging station having an image detector, a computer that can determine an image analysis, three orienting stations that operably receive the analysis and can rotate the object about perpendicular axes, and a transfer mechanism having a compliant object carrier that is movable translationally and substantially immovable rotationally. The detector operably images an object, the computer operably determines the image analysis, and the three stations operate to orient the object according to the analysis.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
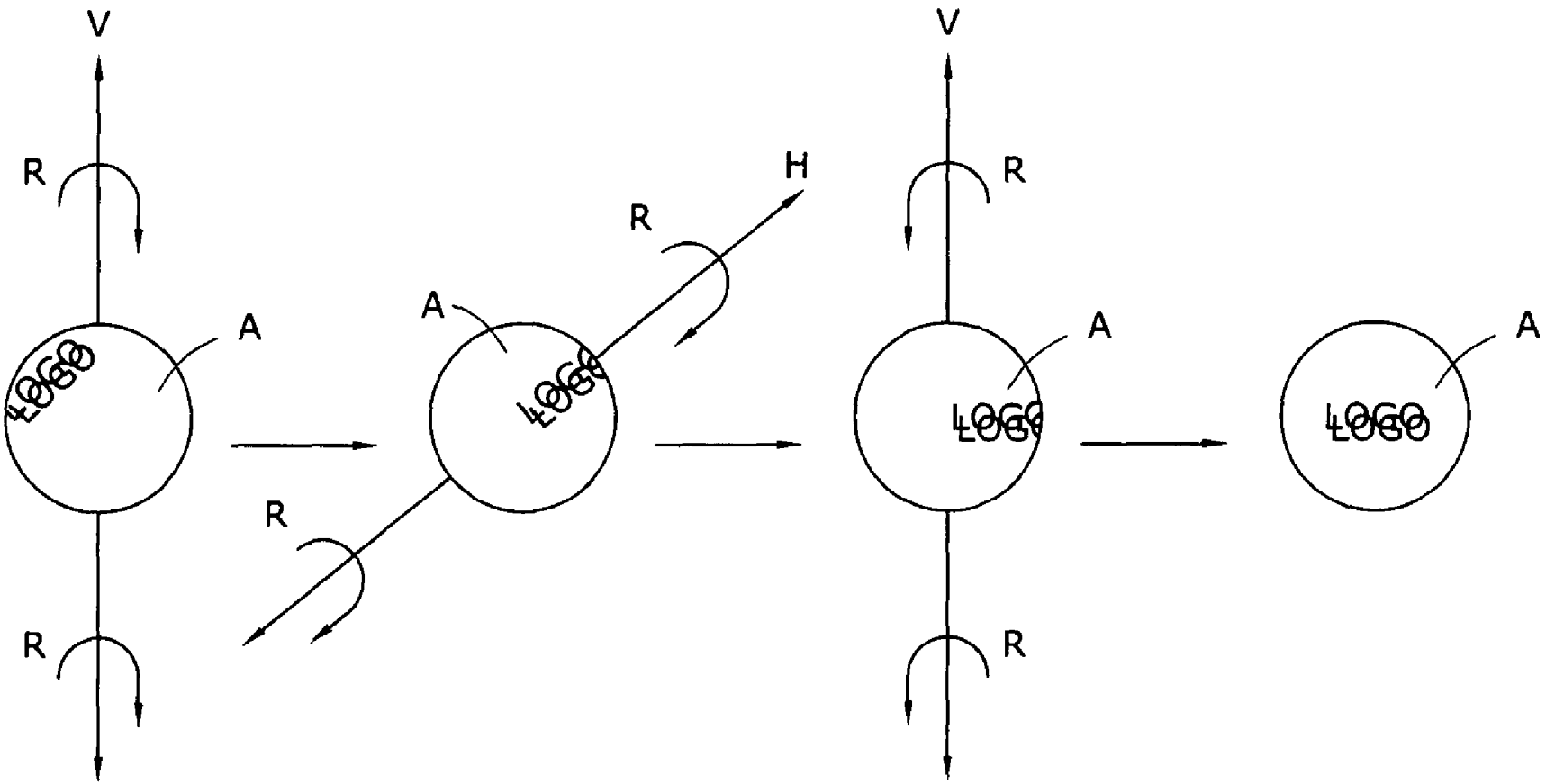
FIG. 1 is a stepwise perspective illustration of one method of orienting a golf ball about alternately perpendicular axes, according to the present invention.

As illustrated in the accompanying drawings and discussed in detail below, one aspect of the present invention is directed to a method of efficiently and accurately orienting golf balls using an automatic vision system. This method affords quick and accurate golf ball orientation. In one embodiment this method orients golf balls for subsequent inspection of indicia by a camera as described below. Suitable cameras include, but are not limited to, line scan camera, area scan camera, and multiple are scan camera. Another aspect of the present invention is directed to an orienter for doing the same, which is also illustrated and described below.

Once a golf ball is marked with indicia (e.g., labels, logos, dimples, or other markings), golf ball indicia are inspected to ensure compliance with a prescribed set of quality standards. This inspection is automatically performed by a line-scan vision system connected to a computer, which analyzes whether each indicium is acceptable. A more complete description of the various techniques and equipment required for such analysis is found in the '998 patent, previously incorporated herein by reference.

To perform this inspection, each golf ball indicium is placed in front of the line scan camera. A line scan camera is a type of camera that very quickly captures a row of pixels. As a ball is rotated, the camera captures multiple rows in concert with the rotation, which are then assembled to form a two-dimensional image of the ball's surface, which includes the indicia to be inspected. To inspect and compare the indicia with a paradigmatic example, however, each indicium should be centered, positioned, and in fact oriented—as closely as possible—so that it is faced upright and directly in front of the camera.

Orienting a golf ball is a two-step process. First, the ball is imaged to determine the random location of one of its indicia. Second, it is oriented and placed in front of the line scan camera that will inspect it. After orienting the golf ball every component of the indicium, as closely as possible, occupies a predetermined position with respect to the camera. Regarding the orienting step, three distinct rotational movements can be used to accomplish orientation of a randomly positioned golf ball or other spherical object. The first movement is about a first axis. The second movement is about any second axis preferably perpendicular to the first axis. The third movement is about any third axis that is perpendicular to the second axis, including even, the first axis. In other words, to rotationally reposition any area on a sphere so that it occupies any other directional and positional posture (i.e. faces any direction in any position) requires only three distinct rotational movements about any three perpendicular axes.

Using this method, any randomly positioned golf ball indicium can thus be oriented by rotating the ball only three times, about three alternately perpendicular axes. For instance, successful orientation may start with a rotation about a vertical axis, proceed to a rotation about a horizontal axis, and finish with a rotation about a vertical axis. Other exemplary combinations that can be used to achieve orientation include sequential rotation about a horizontal axis, a vertical axis, and then a horizontal axis; as well as rotation about each of the three axes (X, Y, and Z) of a three-dimensional Cartesian coordinate system.

Referring to FIG. 1, golf ball A as seen from the perspective of an inspection camera (not shown), has defectively stamped indicium, "LOGO." "LOGO" has been accidentally double-stamped. Thus, because golf ball A should be rejected, it is re-oriented so that "LOGO" faces, and is centered upright, and directly in front of, the inspection camera. Ball A is sequentially rotated as indicated by direction arrows R, about respective axes of rotation V, H, and V. Viewed from the perspective of the camera then, it is seen that a proper orientation can be achieved through stepwise rotations about alternately perpendicular axes V, H, and V, where V is a vertical axis and H is a horizontal axis.

Figure 2:
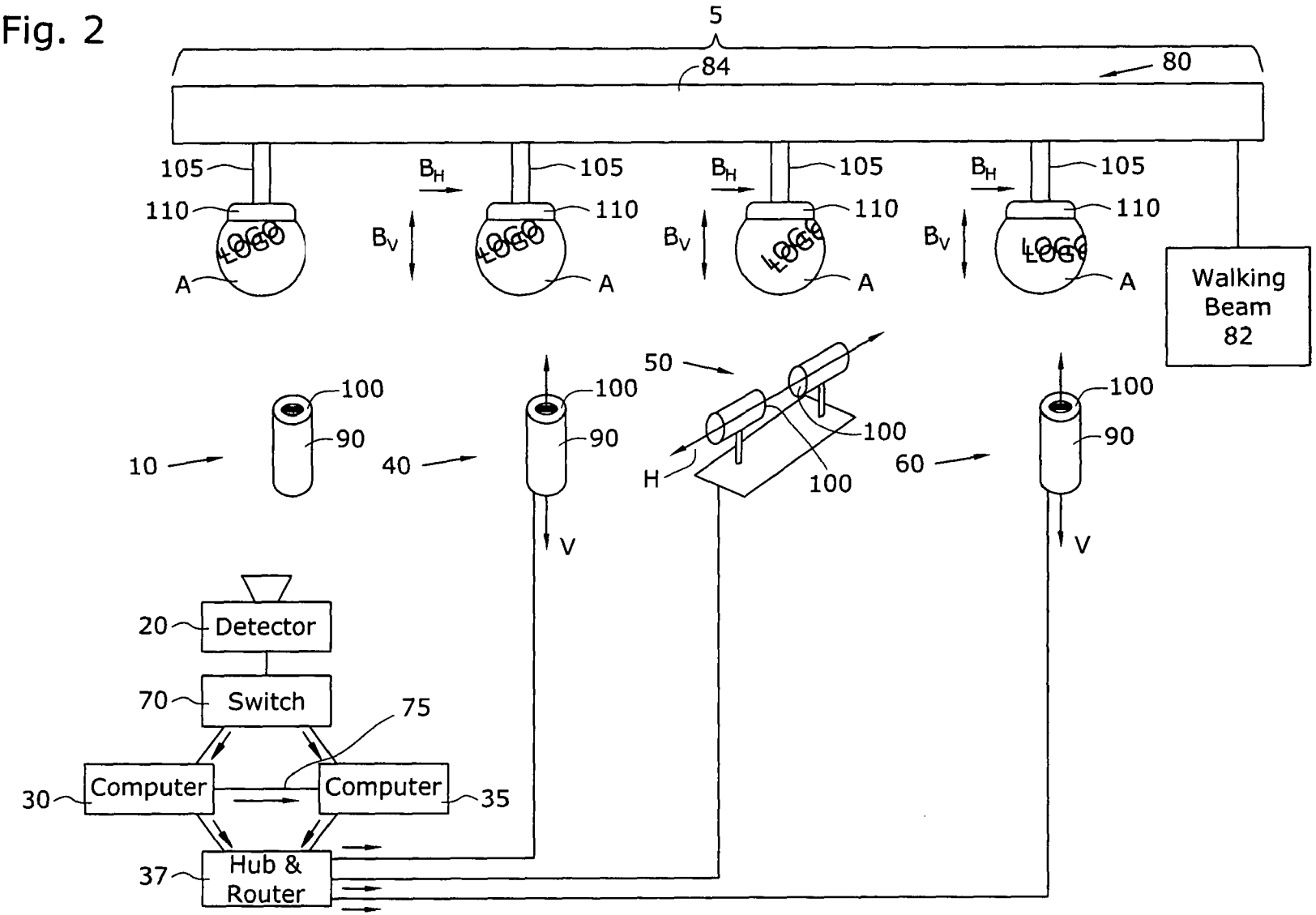
FIG. 2 schematically illustrates an automated embodiment of the orienting method in FIG. 1 that comprises a transfer mechanism, wherein the transfer mechanism comprises a walking beam to index, and suction cups to hold the ball.

FIG. 2 illustrates one embodiment of the method of this invention wherein ball A is sequentially rotated about vertical axis V, horizontal axis H, and vertical axis V, according to calculations made by computer 30. First, golf ball A, which has indicia having a random orientation, is detected at imaging station 10 by line scan detector 20, while golf ball A rotates on top of ball holder 90. Then, golf ball A is rotated at orientating stations 40, 50, and 60 to achieve a correct orientation.

After detector 20 takes an image of ball A, transfer mechanism 80 transfers golf ball A, as shown by direction arrows $B_V$ and $B_H$. Ball A is first transferred from imaging station 10 to first orienting station 40, where golf ball A is rotated about vertical axis V. Ball A is then transferred from first orienting station 40 to second orientating station 50, where golf ball A is rotated about horizontal axis H. Finally, ball A is transferred from second orienting station 50 to third orienting station 60, where golf ball A is rotated about vertical axis V. The amount of rotation about each of these three alternate perpendicular axes is determined and communicated to each orienting station by computer 30, as is described below.

Between each rotation, transfer mechanism 80 indexes golf ball A from one station to the next station. Thus, transfer mechanism 80 comprises equipment suitable to pick up ball A from one station, forward to transfer ball A to a position above the next station, and down to place ball A at the next station. In one embodiment, transfer mechanism 80 includes walking beam 82, transfer beam 84, holder arms 105 and vacuum cups 110. As walking beam 82 indexes in a box-shaped motion, transfer beam 84 pivots about connection points (not shown) that connect it to walking beam 82 so that beam 84, mounted holder arms 105, and mounted vacuum cups 110 remain horizontal.

The particular sequence of each indexing motion for a single ball A includes three sub-steps. First, cup 110 provides suction, which holds ball A in place. Second, transfer mechanism 80 indexes ball A, which moves it out of one station, and moves it to another. Finally, cup 100 stops suction, which allows transfer mechanism 80 to place ball A at each of stations 40, 50, and 60. Used in this fashion, transfer mechanism 80 repeatedly indexes ball A from station 10, to station 40, to station 50, and finally to station 60 in between rotations. Suitable walking beams can be obtained from Industrial Motion Control, LLC.

As transfer mechanism 80 indexes golf ball A, image data flow from line scan camera detector 20 to computer 30, which analyzes the data. Computer 30 then communicates rotational directions to first orientation station 40, second orientation station 50, and third orientation station 60 according to the resulting analysis. A more complete description of suitable detectors, computers, and related analysis is disclosed in the commonly owned '998 patent, previously incorporated herein by reference.

To increase system throughput, switch 70 automatically alternates the flow of data from detector 20 to computers 30 and 35 with each ball that is detected. For golf ball A, image data flows from imaging station 10 to computer 30. To distribute processing work among computers 30 and 35, switch 70 then directs image data for the next golf ball (not shown) in orientation line 5 to computer 35. Repeating this alternate flow of data increases overall production speed even when dual processor computers are used, because of the time required for one computer to determine a golf ball's original orientation and provide an orientation analysis is shared. Alternately, to increase throughput processing may be shared by several CPUs in a multiprocessor computer, preferably by a technique called multithreading by which the processing of a ball is shared by multiple processors.

In an alternate embodiment, computers 30 and 35 are used in tandem by transferring data from one of computers 30 or 35 to the other through network connection 75. When needed, computer 30 sends data to computer 35, and computer 35 analyzes the data either in whole or in part. This set up also increases orienting throughput efficiency.

Orienting stations 40, 50, and 60 rotate balls A according to the analysis provided by computer 30, or alternately computer 35. To rotate ball A, stations 10, 40, and 60 are equipped with motorized, rotating ball holders 90 that have vacuum cups 100, which hold golf ball A in place through pneumatic suction. Horizontally rotating station 50 is equipped with a pair of horizontally extendable and rotating ball holders 90, each having one vacuum cup 100. Cups 100 holds golf ball A between successive pick-ups and placements of golf ball A by vacuum cups 110, which receive and hold golf balls A from cups 100 at the beginning of each indexing motion by transfer mechanism 80.

Figure 2A:
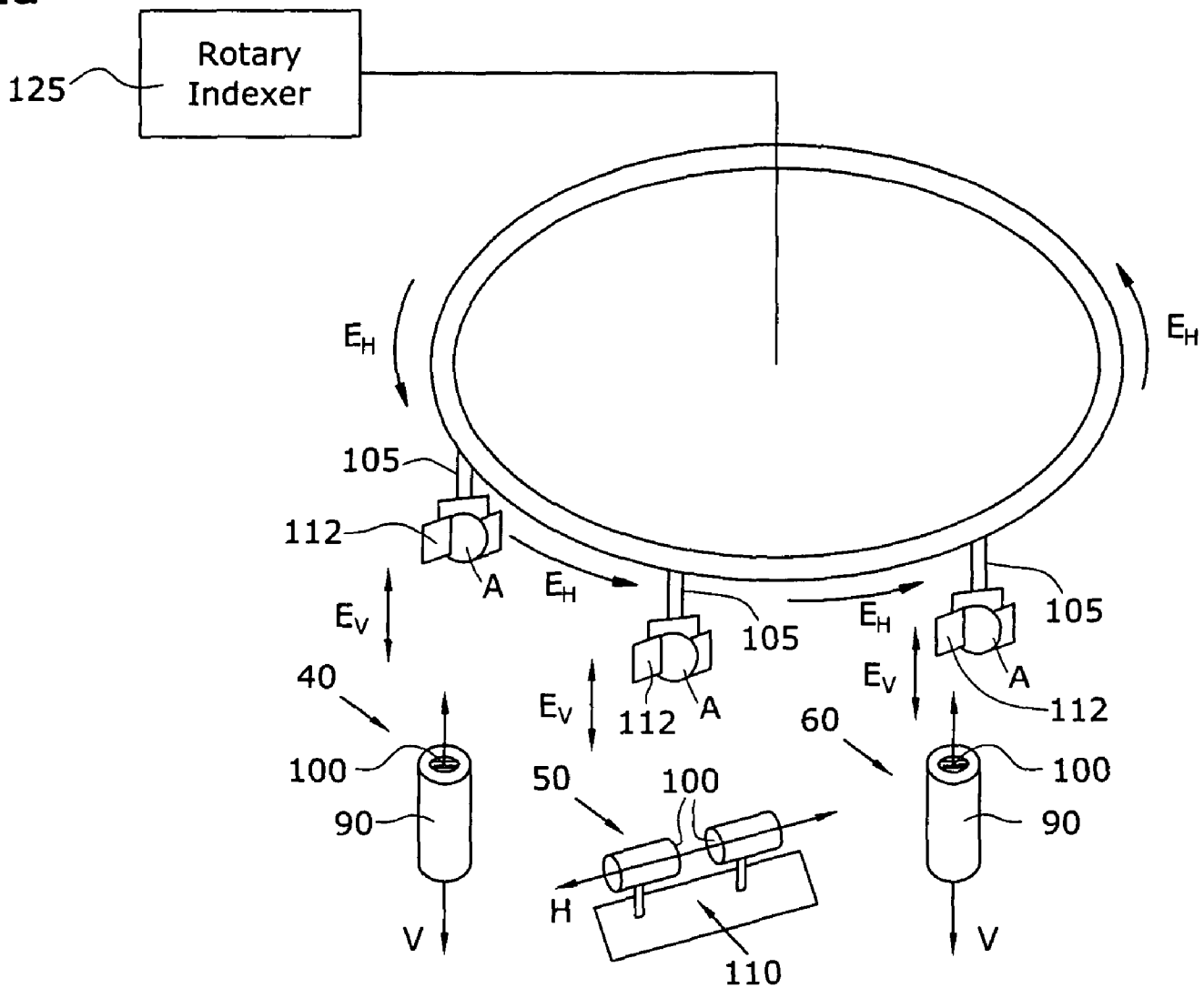
FIG. 2*a* schematically illustrates an alternate embodiment of the method in of FIG. 2, wherein the transfer mechanism comprises a rotary indexer to index, and gripping members to hold the balls.

Referring to FIG. 2*a*, in an alternate embodiment transfer mechanism 80 uses rotary indexer 125 to index ball A from station-to-station according to direction arrows $E_V$ and $E_H$. Suitable rotary indexers include a servo-driven dial table or a cam driven mechanical indexer such as a "Cambot" parts handler, which can be obtained from Industrial Motion Control, LLC (Camco-Ferguson). Many suitable multiple motion index drives, such as linear mechanical indexers, can be configured to practice this invention as well.

Referring again to FIG. 2, it is important to note that during indexing, transfer mechanism 80 holds ball A to prevent rotational slipping during transfers between orienting rotations. Vacuum cups 110 on holder arms 105 carry ball A during each transfer. They provide vacuum suction during the entire engagement, pick up, transfer, placement, and release steps of each indexing motion, which keeps ball A in place so that it does not rotationally slip between rotations.

Referring to FIG. 2*a*, in an alternate embodiment, gripping members 112 grip to firmly engage ball A after it is imaged and rotated at respective stations 10, 40, and 50, until ball A is picked up, transferred, and placed at its next station. Suitable gripping members 112 alternately keep ball A from rotationally slipping as it is transferred from one station to the next.

Figure 3:
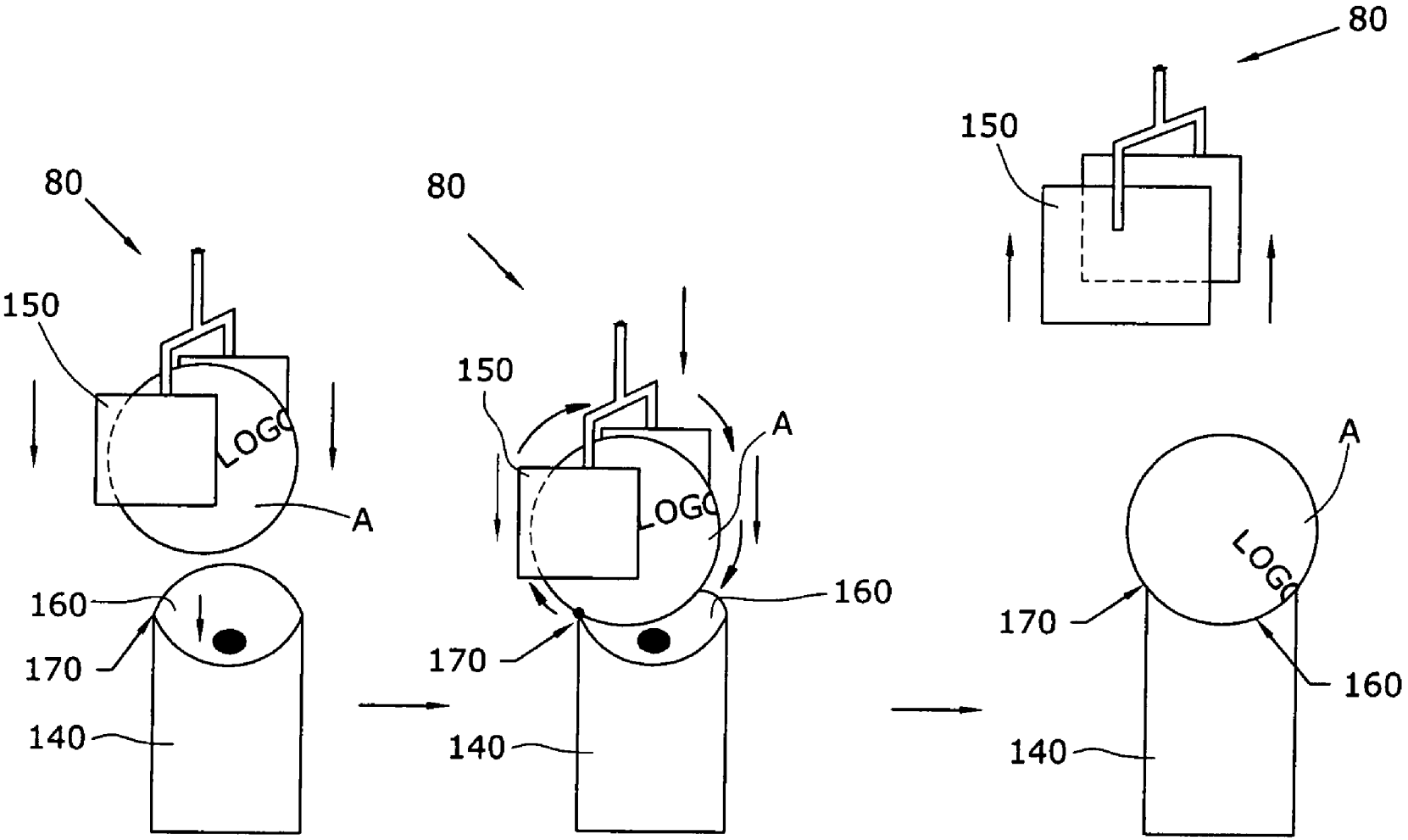
FIG. 3 is a perspective plan view of a misaligned ball carrier and holder cup at various stages of a golf ball transfer from one station to another station, according to the present invention.

As shown in FIG. 3, golf ball A nevertheless may tend to shift because of misalignment of ball A as it is placed into holder 140. As golf ball A is placed into motorized rotating ball holder 140, golf ball misalignment between golf ball A and rotating holder 140 causes unintentional rotational slipping. As gripping member 150 advances toward ball A, ball A is incorrectly aligned with cup 160. Thus, as gripping member 150 places golf ball A into cup 160, ball A rotates sideways into cup 160 as edge 170 catches golf ball A. Because gripping member 150 rigidly holds golf ball A and because cup 160 rigidly receives ball A, neither ball A nor cup 160 give, thereby causing an unintended rotation which shifts the orientation of ball A. This slip in turn prevents accurate orientation. Similar rotational slip caused by a misalignment between cup 140 and ball A can also occur as ball A is picked up from cup 140 (not shown).

Figure 4:
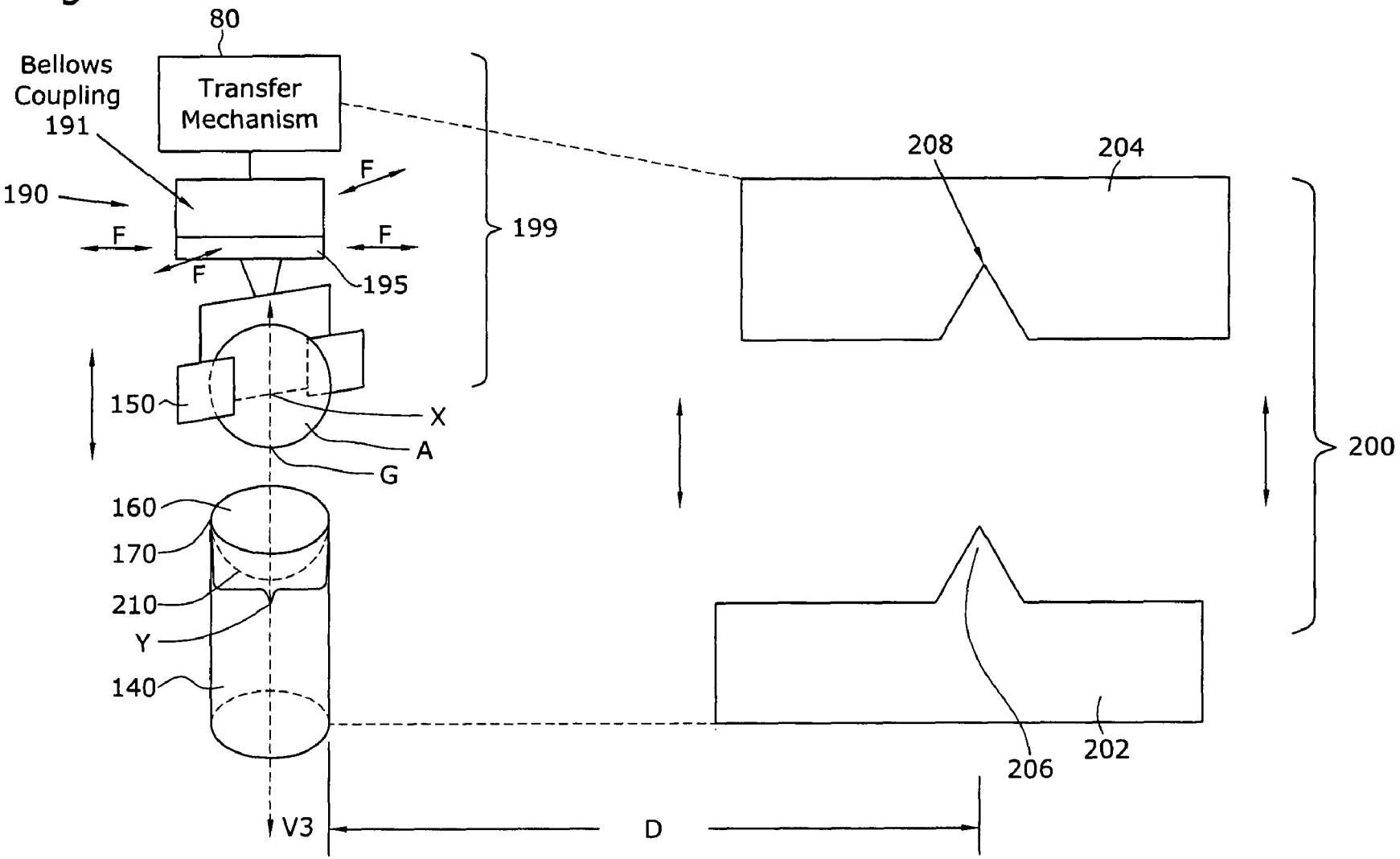
FIG. 4 schematically illustrates one embodiment of the automated orienting method in FIG. 2 that uses a compliant ball carrier, wherein a V-block mechanism guides the golf ball into the rotating holder cup.

Referring to FIG. 4, transfer mechanism 80 accordingly further includes a compliant object holder in one embodiment, which promotes orienting accuracy by preventing unintended golf ball rotational shift. To prevent unintended shift caused by a misalignment of ball A and cup 160, alignment mechanism 190 couples transfer mechanism 80 to gripper 150, which forms compliant ball carrier 199.

One suitable compliant ball carrier 199 specifically includes arm 195, which is free to extend and pivot, but not to rotate. Arm 195 freely moves back and forth, side-to-side, and up and down according to directional arrows F, but it does not rotate along any axis or otherwise allow rotation of golf ball A. Thus, arm 195 is movable translationally (i.e., along linear and curvilinear paths), and substantially immovable rotationally.

One suitable alignment mechanism 190 that provides and limits rotational movement as such is bellows coupling 191.

By allowing only non-rotating motion, compliant object carrier thus reduces unintended rotational shift during ball transfer.

In addition, cup 160 is sized and dimensioned to receive ball A. Cup 160 has internal diameter Y, which is approximately equal to outside diameter X of ball A. Relatively dimensioned as such, ball A itself guides ball carrier 199 into alignment with cup 160 as ball A advances toward, and is placed into, cup 160.

V-block mechanism 200 is used in conjunction with alignment mechanism 190 to help guide compliant ball carrier 199 into alignment with cup 160. V-block members 202 and 204 have respective center points 206 and 208. Bottom center point 206 is situated at a horizontal distance D from bottom point 210 of cup 160. Mounted directly above bottom center point 206, top center point 208 is likewise situated to be the same horizontal distance D away from bottom surface point G of ball A as center point 208 is from bottom point E. Thus, as transfer mechanism 80 indexes to lower ball A, V-block member 202 advances toward and engages V-block member 204 and helps to align ball A with cup 160. As a result, point G on ball A and bottom point 210 on cup 160 align along vertical axis V3. Thus, V-block 200 helps to correct rotational misalignment, if any, about vertical axis V3.

Figure 5:
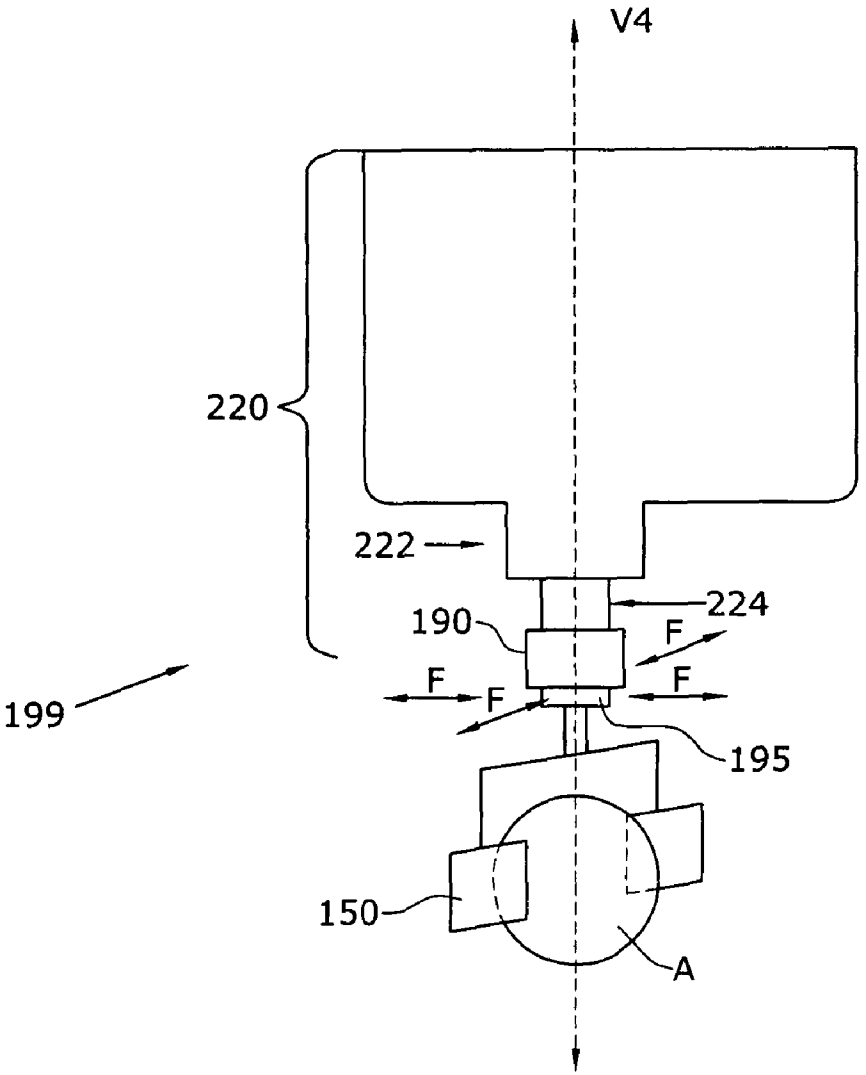
FIG. 5 schematically illustrates an alternate embodiment of the automated orienting method in FIG. 2, wherein a shot pin helps to guide the golf ball into the rotating holder cup.

Referring to FIG. 5, in an alternate embodiment, shot pin mechanism 220 is used in conjunction with alignment mechanism 190 to help guide compliant ball carrier 199 into alignment with cup 160. Shot pin 220 has rectangular housing 222 that houses reciprocating rectangular pin member 224, which cannot rotate about vertical axis V4. Shot pin 220 thereby prevents rotational movement of ball A about vertical axis V4.

Figure 6:
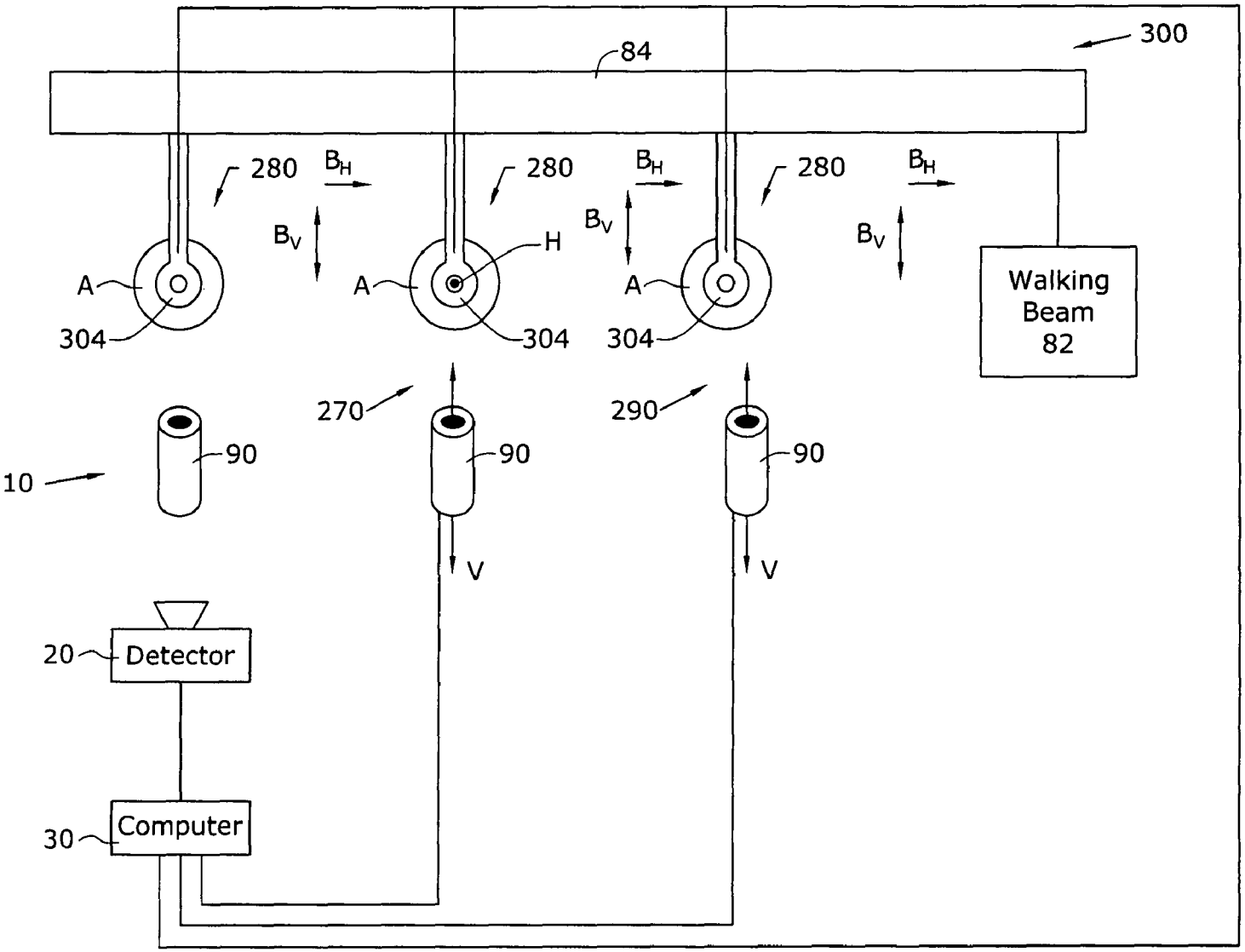
FIG. 6 schematically illustrates another automated embodiment of the orienting method in FIG. 1, that incorporates the horizontal rotation of the golf ball into a golf ball transfer step.

Referring to FIG. 6, in an alternate embodiment, the step of horizontally rotating ball A about horizontal axis H is incorporated into a ball transfer indexing motion of transfer mechanism 300. In this embodiment, transfer mechanism 300 operates in substantially the same way as transfer mechanism 80 described in FIGS. 1-5. However, orientation in this embodiment includes the step of vertically rotating ball A at first orienting station 270; horizontally rotating ball A at second orienting station 280, which is mounted, at least in part, onto transfer mechanism 300; and vertically rotating ball A at orienting station 290. In this embodiment, ball A is imaged by detector 20; image data are analyzed; and computer 30 communicates the analysis to orienting stations 270, 280 and 290, which rotate ball A according to the resulting analysis.

Figure 6A:
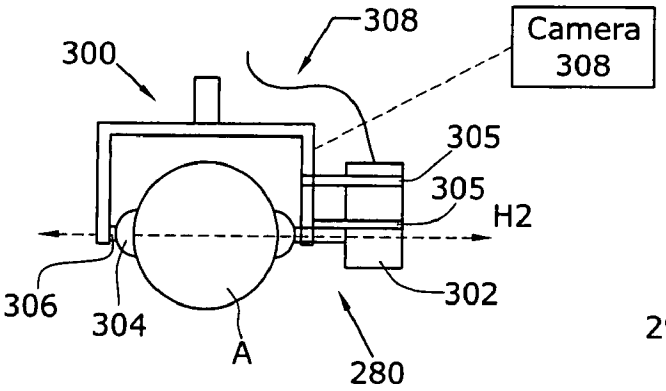
FIG. 6*a* is a cut away portion of the horizontal orienting station in FIG. 6, showing a spindle and motor mounted to it.

Referring to FIG. 6*a*, in one embodiment, orienting station 280 more specifically comprises rotational electric, or alternately pneumatic, motor 302, which is mounted onto gripping members 304. Motor 302 engages and rotates spindles 306, which actively rotate ball A about horizontal axis H. Motor 302 is mounted onto transfer mechanism 300 with slip rings 305. Electric lead 308 transmits communications from computers 30, which communicates the amount of required rotation about the horizontal axis. In an alternate embodiment, any suitable controls for motor 302, such as radio frequency remote controls, can be used.

Figure 7:
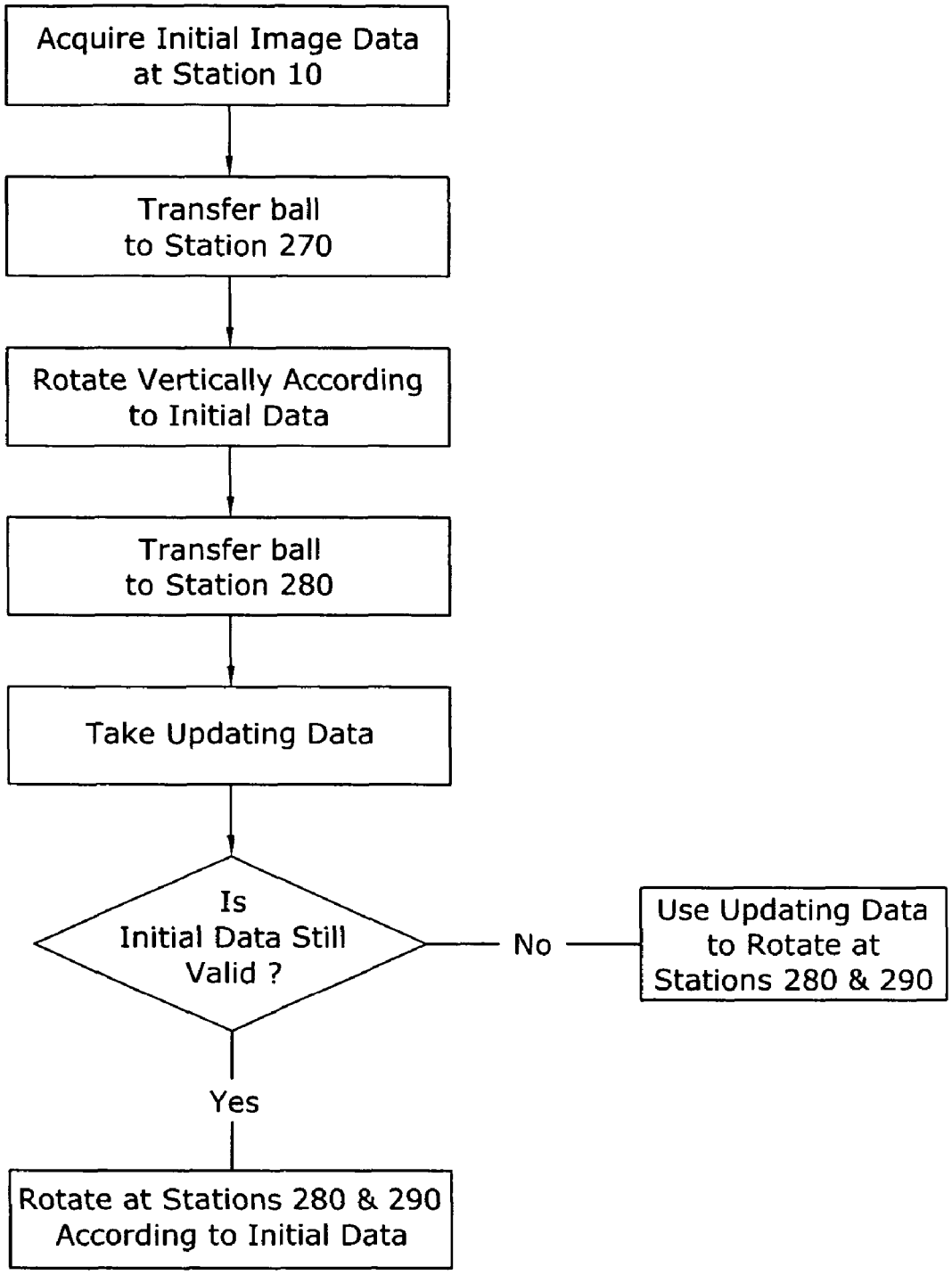
FIG. 7 is a schematic flow chart of the automated embodiment of FIG. 6*a*, wherein a camera mounted on the transfer mechanism takes an updating image data of the ball that can override initial image data.

In one embodiment, line scan camera 308 is mounted onto transfer mechanism 300 along with motor 302 to image ball A during the horizontal rotation by motor 302. Referring to FIG. 7, updating image data are transferred to computer 30 to monitor the accuracy of (1) transfers from station 10 to 270, from station 270 to 280, and (2) the first rotation at station 270. The updating image data is compared with the original data. If the data do not match, the previously calculated analysis for orientation is recalculated, and computer 30 sends a correcting signal to station 280 and station 290 that overrides the first communication. If, on the other hand, the initial data match the updating data, ball A is rotated at stations 280 and 290 according to the initial data taken at imaging station 10.

Figure 6B:
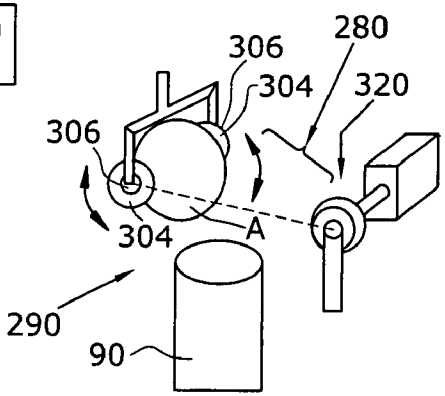
FIG. 6*b* is a cut away view of an alternate embodiment of the horizontal orienting station in FIG. 6, that has a friction wheel that drives a spindle.
Figure 6C:
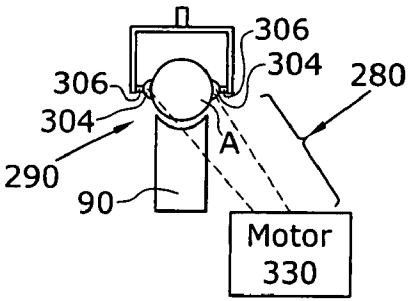
FIG. 6*c* is a schematic cut away view of another alternate embodiment of the horizontal orienting station in FIG. 6, that magnetically couples a motor to a mounted spindle.
Figure 6D:
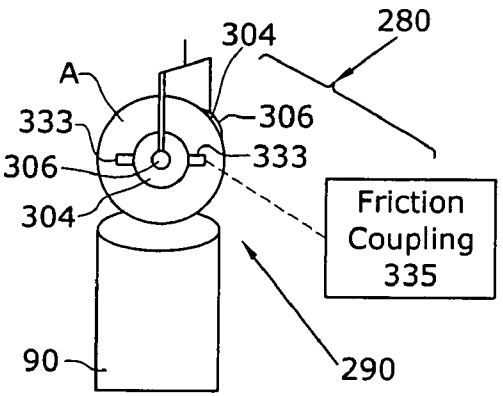
FIG. 6*d* is a schematic cut away view of yet another alternate embodiment of the horizontal orienting station in FIG. 6, that has a friction coupling that pushes a spindle.
Figure 6E:
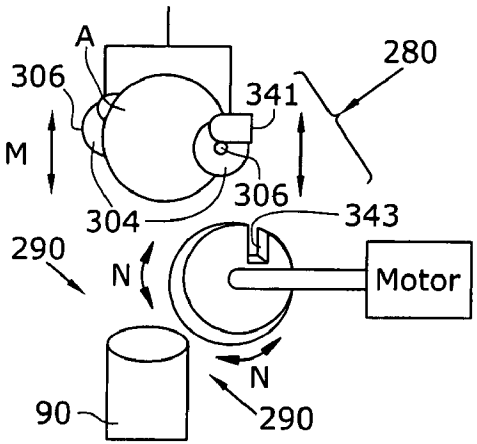
FIG. 6*e* is a cut away view of still another alternate embodiment of the horizontal orienting station in FIG. 6, that has a slot that receives and engages a spindle.

Referring to FIGS. 6*b*, 6*c*, 6*d*, and 6*e*, after transfer mechanism 300 has indexed ball A into position at orienting station 290, but before gripping members 304 release ball A, several alternate embodiments exist for horizontally rotating ball A during a transfer motion. Referring to FIG. 6*b*, in one such embodiment, orienting station 280 comprises spindles 306 coupled to motorized friction wheel 320, which horizontally drives one of spindles 306 and thus, ball A. Referring to FIG. 6*c*, in another embodiment, orienting station 280 comprises spindles 306 that are magnetically coupled to motor 330. In this embodiment, the motor has a magnetic member that exerts a magnetic force on the spindle 304. The motor rotates this magnetic member, which in turns rotates the spindle. This type of drive resembles a magnetic clutch. Referring to FIG. 6*d*, in still another embodiment, orienting station 280 comprises spindles 306 that are pushed on one or more of their ends 333 with friction coupling 335. Friction coupling comprises a driving friction wheel that contacts a driven wheel attached to spindle 306. As the driving wheel is rotated by a motor, the driven wheel also rotates. Referring to FIG. 6*e*, in yet another embodiment, orienting station 280 comprises blade 341 mounted on spindle 306 that engages slot 343 as ball A indexes toward orienting station 290. This is show by direction arrows M. Engaged slot 343 rotates spindle 306 as shown by direction arrows N. Thus, in each of these embodiments illustrated in FIGS. 6*a*-6*e*, orienting station 280 is at least partially mounted onto transfer mechanism in the form of spindles 306 and gripping members 304.

In these embodiments, driving mechanisms that allow disengagements at any fraction of a revolution, such as the friction wheel coupling or the magnetic clutch coupling, are preferred. The blade and slot driving mechanism can be designed to rotate a ball at any fraction of one revolution. Certain blade and slot driving mechanisms that rotate in predetermined increments are more suitable when rotation in fixed increments is preferred.

Figure 6F:
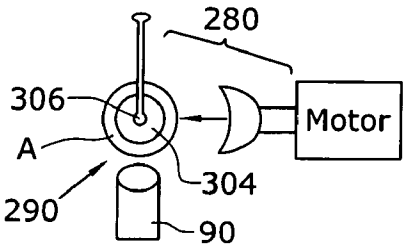
FIGS. 6*f* and 6*g* are a cut away view of still another alternate embodiment of the horizontal orienting station in FIG. 6, that has a driven cup that clamps onto a golf ball.
Figure 6G:
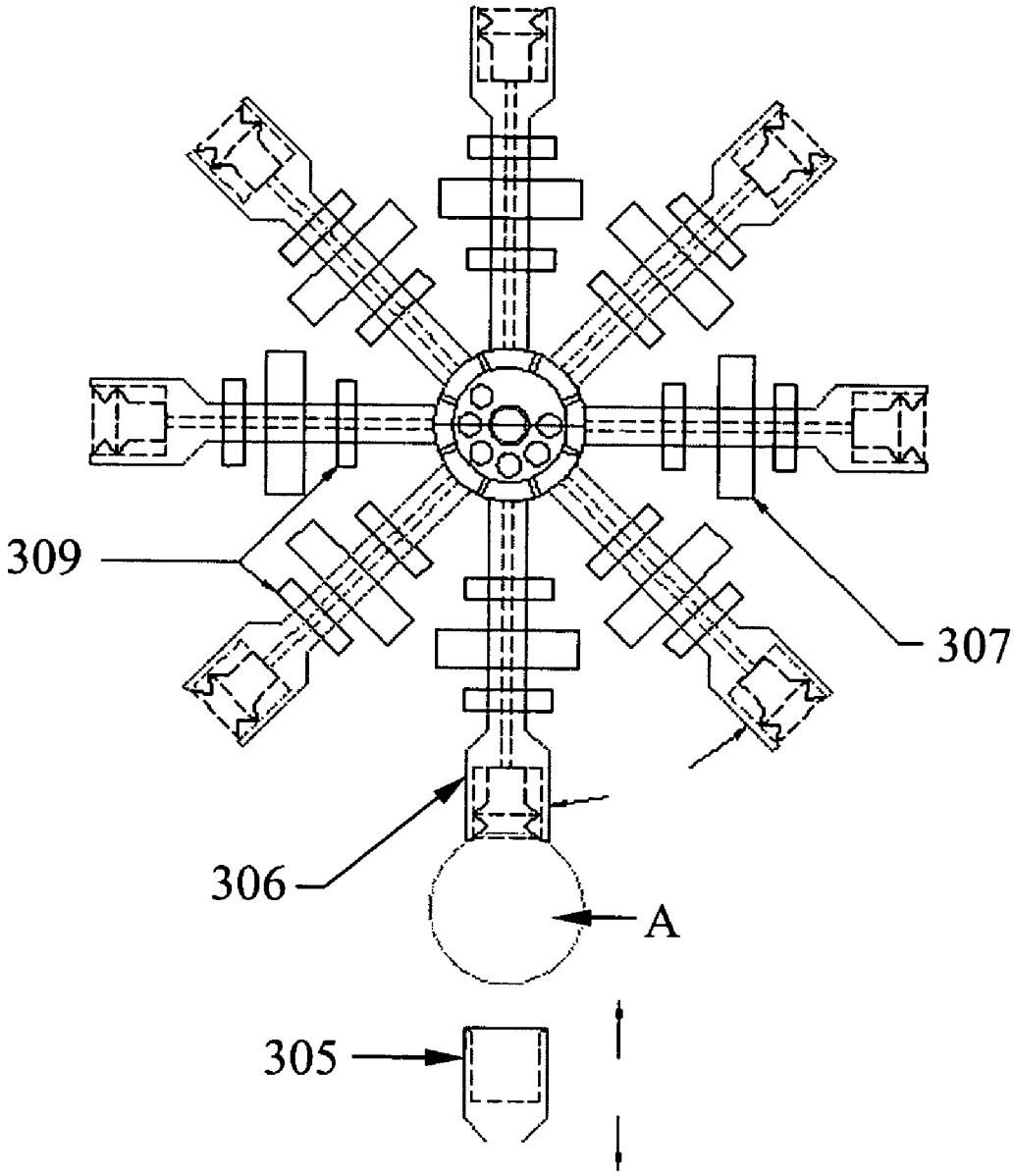

Referring to FIG. 6*f*, in another embodiment, orienting station 280 comprises a driven cup that clamps onto ball A. This embodiment is a part rotary indexer shown in FIG. 6*g* similar to those illustrated in FIGS. 2 and 2*a*, except that a driven cup is clamped onto the ball and the transfer mechanism does not release the ball until after the desired rotation is completed. FIG. 6*g* shows spindle 106 holding ball A and drive cup 305 capable of engaging and rotating ball A. Spindle 306 also has driven friction wheel 307, discussed above, and bearings 309 to reduce friction.

Advantageously, the embodiments illustrated in FIGS. 6*a*-6*g*, the ball can be rotated about one axis without being released to minimize errors through slippage caused by transferring the ball from one holder to another. In these embodiments, orientation though horizontal-vertical-horizontal rotations requires only one ball transfer.

Figures 8A, 8B, 8C:
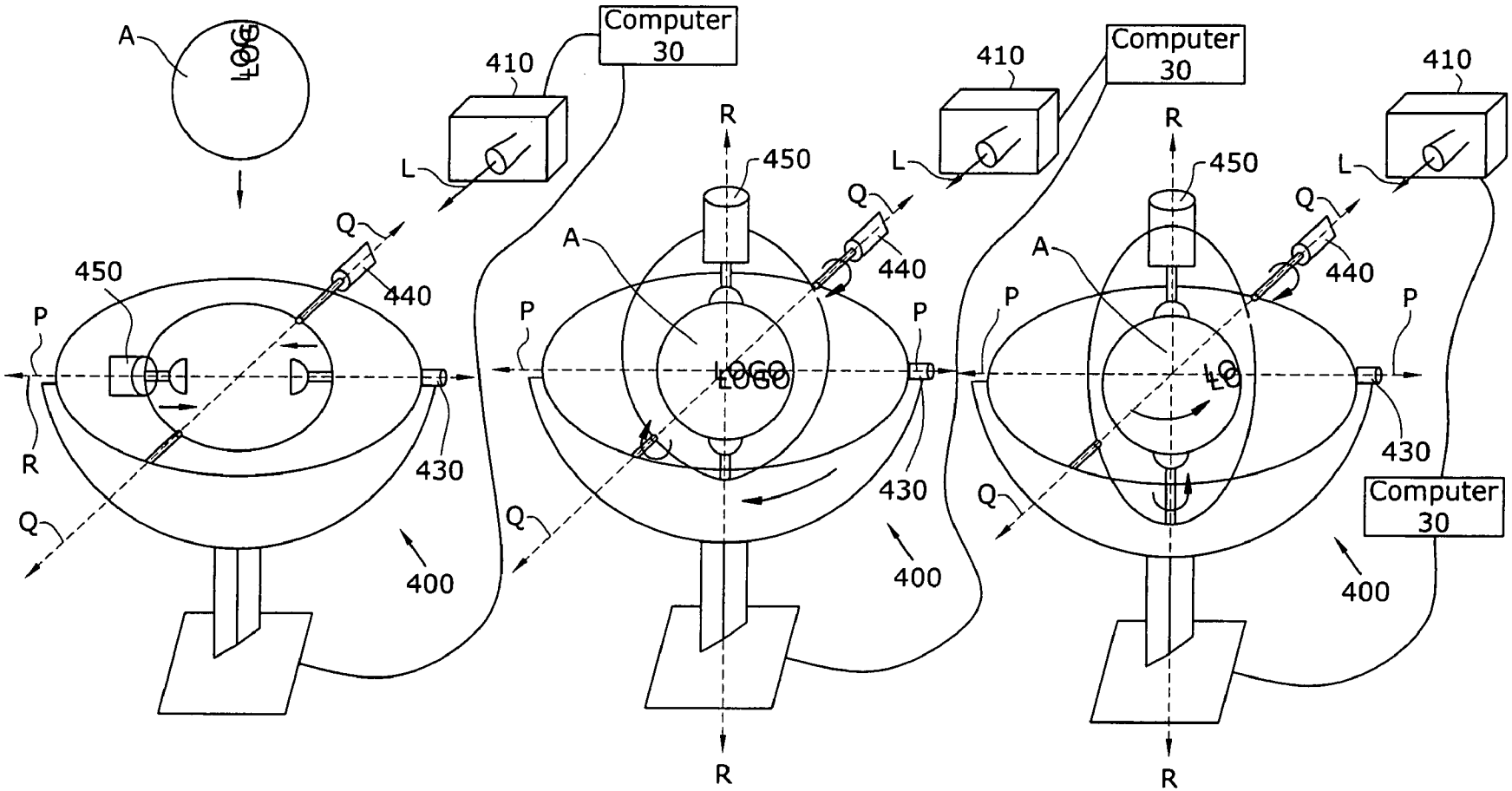
FIG. 8*a* illustrates another method of orienting a golf ball that uses a gimbaled mechanism, according to the present invention, wherein the gimbaled mechanism receives a randomly oriented golf ball.
FIG. 8*b* illustrates the embodiment of FIG. 8*a*, wherein the gimbaled mechanism rotates the ball about a horizontal axis.
FIG. 8*c* illustrates the embodiment of FIG. 8*a*, wherein the gimbaled mechanism rotates the ball about a vertical axis.

Referring to FIGS. 8*a*, 8*b*, and 8*c*, in an alternate embodiment, ball A is imaged and oriented about three perpendicular axes in gimbaled mechanism 400. Referring to FIG. 8*a*, ball A is received by gimbaled mechanism 400 for imaging and indicia inspection by line scan detector 410. Gimbaled mechanism 400 is configured with three independent motors 430, 440, and 450, each of which drives a portion of gimbaled mechanism 400 about a different perpendicular axis. Initially, ball A faces away from viewing line L of detector 410 such that the golf ball indicia "LOGO" require orientation. As gimbaled mechanism 400 rotates ball A, detector 410 scans and collects image data that computer 30 analyzes to determine the directions and amounts of the rotations that should be undertaken to orient ball A. The analysis determines amounts of required rotation about each of the three individual axes P, Q, and R, which may or may not coincide with the X, Y, and Z Cartesian coordinates.

In FIGS. 8*b* and 8*c*, gimbaled mechanism 400 accordingly rotates ball A about axis P with motor 430, axis Q with motor 440, and axis R with motor 450, respectively, to position the indicia, "LOGO," upright, and directly in front of, detector 410 for inspection. Thus, gimbaled mechanism 400 orients ball A.

In an alternate embodiment, ball A is imaged in an imaging station, and then transferred to gimbaled mechanism 400 for orientation.

In any of these or other embodiments herein described, orienting stations and ball carriers may alternately include vacuum cups, in place of, or in addition to, gripping members and vice-versa.

In an alternate embodiment, ball A is rotated about a horizontal axis, a vertical axis and a horizontal axis. In one embodiment, a transfer mechanism incorporates both horizontal rotations into two indexing motions.

A second aspect of the present invention is directed to a spherical object orienter, several embodiments of which are illustrated in the accompanying figures and described above.

Figure 9:
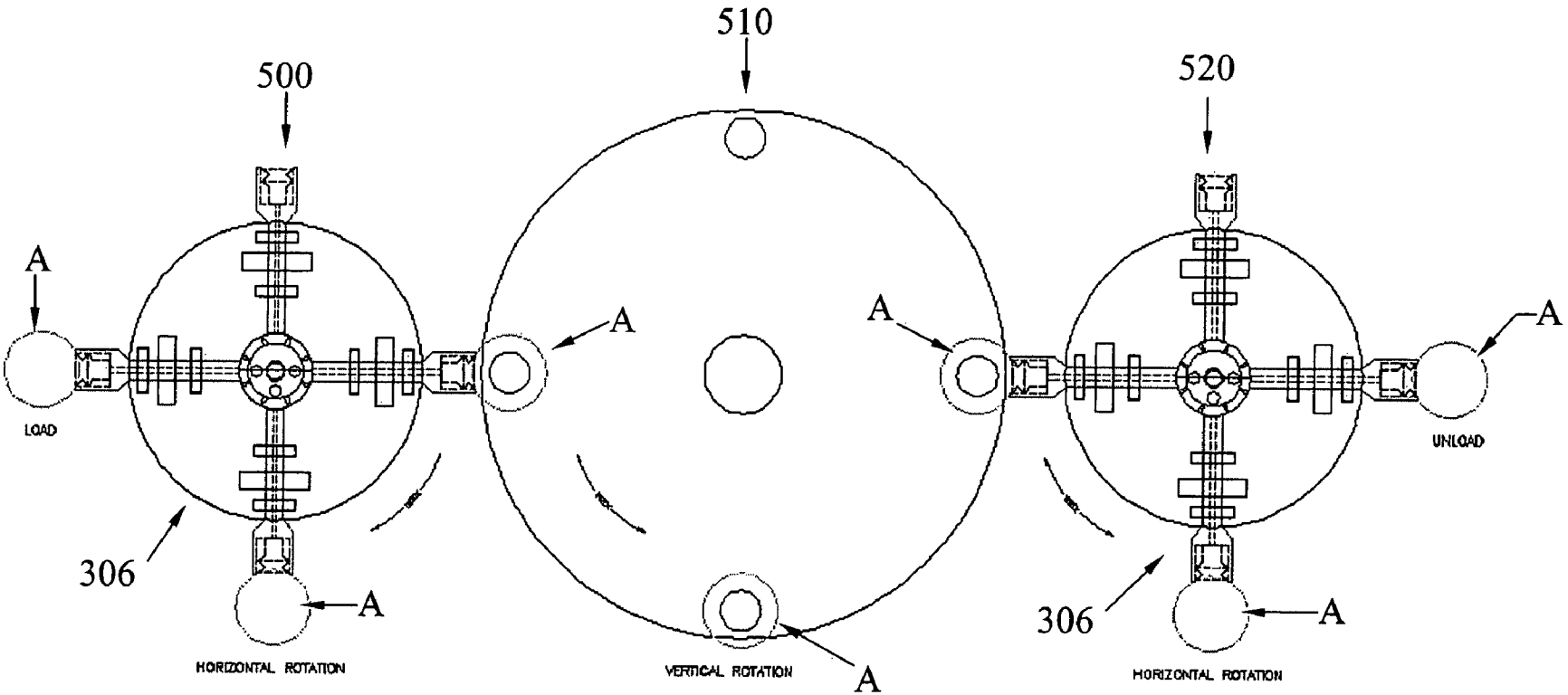
FIG. 9 illustrates three indexing wheels of FIG. 6*g*, each rotating a golf ball in one direction.

Another embodiment of the present invention is illustrated in FIG. 9. Three indexing wheels, similar to the indexing wheel of FIG. 6*g* discussed above, are used to orientate the balls. Balls A is loaded at indexing wheel 500 from the left and is held by the suction cups. An image of the ball is obtained and a proper amount of rotations is determined. An appropriate amount of horizontal rotation is imparted on to the balls. The balls are then transferred to indexing wheel 510 in the center for rotation in an appropriate amount in the vertical direction. The balls are then transferred to indexing wheel 520 for the third rotation, e.g., horizontal rotation, before the balls are unloaded.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments that would come within the spirit and scope of the present invention.

We claim:

1. A method of orienting a spherical object, comprising:

acquiring an image of a spherical object at an imaging station;

analyzing the image with a first computer to determine an orientation analysis;

transferring the object from the imaging station to orienting stations using a transfer mechanism, the transfer mechanism comprising a rotary indexer having multiple extendable vertical arms, each arm having a vacuum cup for picking-up, holding and carrying the object to a station using vacuum suction so the object does not rotationally slip and the object remains rotationally fixed during transfer from station-to-station; and orienting the object to a predetermined orientation at each orienting station according to the orientation analysis;

wherein the orienting stations comprise first, second, and third stations, each station having a motorized, rotating object holder with a vacuum cup for receiving the object from the vacuum cup of the rotary indexer and rotating the object about a single axis; the first, second, and third stations collectively orienting the object by rotation about axes that are alternately perpendicular, the rotating object holder being rotated on a spindle coupled to a motor.

2. The method of claim 1 wherein the object is a golf ball.

3. The method of claim 1, wherein the rotary indexer is a cam-driven mechanical indexer.

4. The method of claim 1, wherein the vacuum cup of the rotating object holder has an internal cup diameter approximately equal to an outside diameter of the object, and the object helps to guide the vacuum cups of the extendable vertical arms of the rotary indexer to the vacuum cups of the rotating object holder.

5. The method of claim 1 further comprising acquiring an image of the object as the motor rotates the object.

6. The method of claim 1 further comprising driving the spindle with a friction wheel to rotate the object.

7. The method of claim 1, further comprising magnetically coupling the motor onto the spindle to rotate the object holder.

8. The method of claim 1 further comprising sliding the spindle into an engaged position wherein the motor is coupled to the spindle as the spindle slides into the engaged position.

9. The method of claim 8 wherein the spindle engages the motor through a blade and slot mechanism while the transfer mechanism indexes the object.

10. The method of claim 1 further comprising alternating a flow of data from the imaging station to a first computer with a flow of data from the imaging station to a second computer.

11. The method of claim 1 further comprising sending image data from a first computer to a second computer that computes and communicates the analysis to the orienting stations.

12. The method of claim 1 wherein two of the three alternate perpendicular axes are vertical.

* * * * *